United States Patent [19]

Krainski et al.

[11] 4,069,799

[45] Jan. 24, 1978

[54] INJECTION PUMP

[75] Inventors: Andrzej Kraiński; Krzysztof Lendzion; Andrzej Lojek; Jerzy Wewiór, all of Warsaw, Poland

[73] Assignee: Warszawskie Zakłady Mechaniczne "Deltawzm", Warsaw, Poland

[21] Appl. No.: 686,803

[22] Filed: May 13, 1976

Related U.S. Application Data

[63] Continuation-in-part of Ser. No. 481,397, June 20, 1974, abandoned.

[51] Int. Cl.[2] ..... F02M 39/00

[52] U.S. Cl. ..... 123/139 B; 123/139 R; 123/139 AG; 123/139 BD; 417/289

[58] Field of Search ..... 123/139 R, 139 B, 139 AA, 123/139 AG, 139 BD; 417/499, 289

[56] References Cited

U.S. PATENT DOCUMENTS

| | | | |
|---|---|---|---|
| 2,251,783 | 8/1941 | Davis | 123/139 R |
| 2,975,776 | 3/1961 | Nicolls | 123/139 R |
| 3,385,221 | 5/1968 | Parks | 417/494 |
| 3,624,823 | 11/1971 | Staudt et al. | 417/499 |
| 3,667,437 | 6/1972 | Dreisin | 123/139 R |
| 3,714,935 | 2/1973 | Dreisin | 123/139 R |
| 3,885,895 | 5/1975 | Staudt et al. | 417/499 |

*Primary Examiner*—Charles J. Myhre
*Assistant Examiner*—Andrew M. Dolinar

[57] ABSTRACT

A multiple plunger injection pump for an internal combustion engine, in which plungers are arranged in alignment in one line. A housing which holds the governor within chambers, is arranged so that all chambers are filled with fuel. The fuel is supplied to the chambers under pressure for purposes of lubricating and cooling the moving parts. The housing has bores into which are fitted pump barrels. The plungers are movable in the barrels. A control rod used for regulating the pump metering, is linked to the base of the barrels for rotational movement of the plungers. A spring presses tappets against a cam for reciprocal movement of the plungers which are provided with spring discs in proximity of a passage supplying fuel to the fuel supply means. The fuel supply means is spaced from the chamber of driving means by the discs, and is connected to the driving chamber by the driving means, through gaps of the spring discs. Part of the fuel supply flows to the chamber of the driving means through the gaps.

5 Claims, 3 Drawing Figures

11
9
12
7
8
35
6
26
30
29
32
28
III
20
18
5a
21
22
24
23
13
10
4
14
31
5
17
16
27
III
15
34
36
19
1
37

INJECTION PUMP

BACKGROUND OF THE INVENTION

The present application is a continuation-in-part of the parent application, Ser. No. 481,397, filed June 20, 1974, abandoned.

This invention relates to a fuel injection pump for an internal combustion engine and more particularly to a multiple plunger injection pump. The plungers are arranged in alignment in one line, and have a common housing with a governor therein. All chambers are filled with fuel, which lubricate and with fuel, which lubricates and cool the moving parts.

A multiple plunger injection pumps with the pressure units arranged in alignment in one line, having well known advantages and being widely used for some time, have also some basic shortcomings in connection with new engines, particularly small and high-speed ones. They are too large and too heavy and are relatively expensive. Basic designs of these pumps have not been changed for dozens of years, and the main direction of their development tends to diminish the distance between pressure sections and the length of pressure unit (on which the pump height depends) with simultaneous attempts for maximal simplification of various secondary construction details, and lowering of production costs.

Considerable simplification of construction, reduction of dimensions and weight, as well as of cost of production of multisection series pumps was reached in pumps with flange or flange-yoke fitting of barrels of pressure units mounted directly or with flange sleeve in the pump housing holes as for example, the pump according to Polish patent application No. P.139465. In these solutions, the sleeve flange or barrel flange is to connect the pressure unit with the pump housing, to set the so-called initial stroke (beginning of compression) and to regulate equal metering of each pressure unit of the pump. Regulation of initial stroke is carried out with spacer washers placed between the flange and pump housing; metering is regulated by turning the barrel flange in relation to the plunger. Thus, fitting and regulation are much easier, and there is no need for a side access to the internal part of the pump, serving previously for fitting and regulation of the pump, and particularly for setting the initial stroke with regulation screw in tappet. Removal of the regulation screw in the tappet diminished the pump height too.

As far as the usage is concerned, such injection pumps are advantageous, in which driving mechanisms are lubricated and cooled by the fuel, since they do not demand lubricating. In the simplest construction example of such an injection pump description of (U.S.A. Pat. No. 3385221) the pressure units are supplied with fuel delivered directly to the chamber where the driving mechanisms is situated. Such a supply for pressure units has some disadvantages since the fuel in the driving chambers is subjected to intensive movement because of continuous movement of tappets and plungers which results in disadvantages for pump action, as effervescence of the fuel in close proximity to the holes through which the fuel is delivered to the work chamber of pressure units. Next, the fuel in the driving mechanisms chamber may be polluted, for instance because of frictional wear of driving mechanism elements. Delivering of impurities inside the barrels may cause rapid wear of precise pressure units, cut-off valves and atomizing nozzles.

It is advisable to, therefore, separate the space of pressure units supply from driving mechanisms chambers. However, pumps in which separation of pressure units supply is realized (for example the pump according to Polish patent application No. P. 134527) have much more complicated construction and are higher than pumps with pressure units supply from chamber of driving mechanism.

The object of the present invention is to reduce multisection injection pumps with flange or flange-yoke mounting of pressure units barrels below the limits reached so far in known designs of such pumps, particularly by providing for a system of fuel lubrication of pump driving mechanisms, which is more advantageous than the designs known so far.

SUMMARY OF THE INVENTION

The object of the present invention is achieved by directing the fuel flow through the chambers of the pump interior to the overflow pipe by a system of connections between the chambers of pump interior. This assures constant flow of fuel through the driving mechanism chambers and simultaneously effectively protects the pressure units supply space against infiltration of impurities and against effervescence and air content in the fuel.

In the pump in accordance with the present invention the pressure units supply space is connected by a channel or channels with the chamber of the rotation regulator mechanism. To which the chambers of the driving mechanism are connected by mutually independent channels. This results in the presence of the fuel in all chambers of the pump housing; the excess of the fuel flows outside the pump through the overflow pipe connected with the chamber of the rotation regulator mechanism.

The space of pressure units supply is separated from the place of pollution and effervescence of fuel, i.e. from the driving mechanism chambers by the discs of springs. The fuel flows into the driving mechanism chambers directly from the pressure units supply space through gaps around the spring discs.

The hole connecting the overflow pipe with the chamber of the rotation regulator mechanism is situated in the upper wall of this chamer over the end of the regulating strip. The overflow pipe is connected to the regulator mechanism chamber through a valve maintaining in the pump, a pressure higher than atmospheric pressure. This is necessary to avoid injection system aeration.

The invention provides a pump more simple and of lower height than the known pumps with the pressure units supply system separated from driving mechanism chambers. The system of fuel lubrication of pump driving mechanism advantageously uses the known flange or flange-yoke mounting of pressure units since in such a case, there is need for neither a side access to the pump interior, nor for passage capacity of the holes in the pump body for the pressure units. Thus, in the case of filling the pump interior with compressed fuel, particularly advantageous to reduce as far as possible, the quantity of holes in the external walls of the pump housing.

The pump in accordance with the present invention has fewer of such holes than known similar pumps. This results from the fact that the channel delivering the fuel is located at the side of the chamber of the rotation regulator mechanisms, and that the overflow hole is situated more advantageously.

It should be emphasized here that the overflow hole is situated in the upper wall of the chamber of the rotation regulator mechanism directly over the highest part of the pump interior, not only because of the pump de-aeration. During the pump regulation, a need arises to have easy access to the control rod because observing this rod is the simplest way of checking the correctness of metering regulation mechanism action. In the pump, in accordance with the present invention, the movement of the control rod can be watched through the overflow hole, after screwing out the overflow valve. So the advantageous situation of the overflow hole avoids the necessity of the special hole in the pump housing for observation of the control rod.

The present invention has some advantages, furthermore, in assembling the pump. They result from the location of the discs of spring in close proximity to the space of pressure units supply by the fuel delivery channel. The resistance rings of the discs of springs are partly exposed by the fuel delivery channel which makes rings disassembling easier. Besides, the discs of springs may be removed from the pump without removal of the control rod, by pushing the disc aside to the fuel delivery channel.

BRIEF DESCRIPTION OF THE DRAWINGS

The present invention is shown as an example in the drawings, where.

Figure 1:
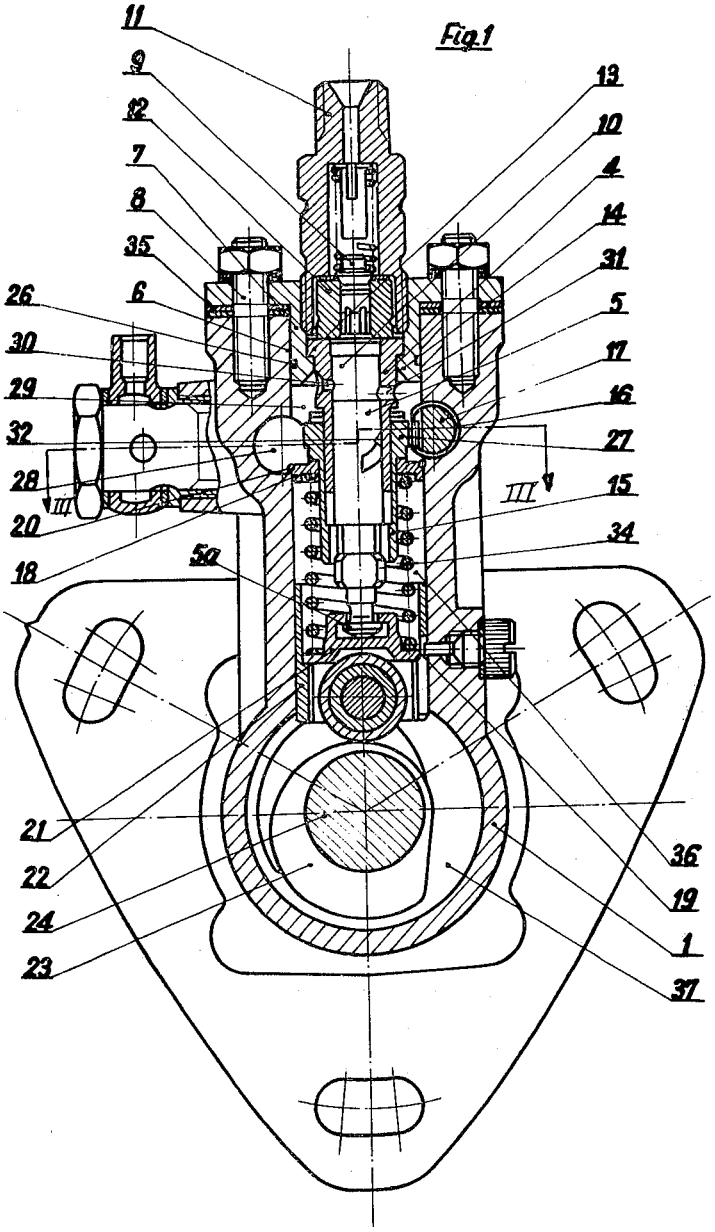
FIG. 1 shows the pump in axial cross-section with section I-I shown in FIG. 2.
Figure 2:
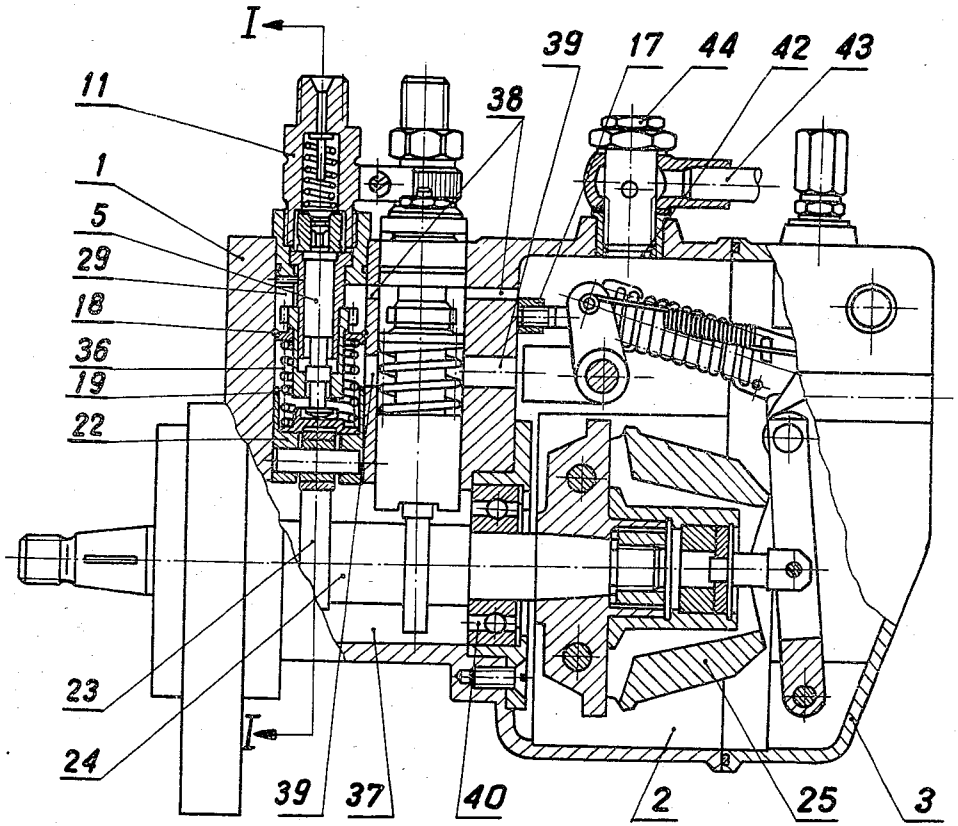
FIG. 2 is an axial longitudinal section with partial side view.
Figure 3:
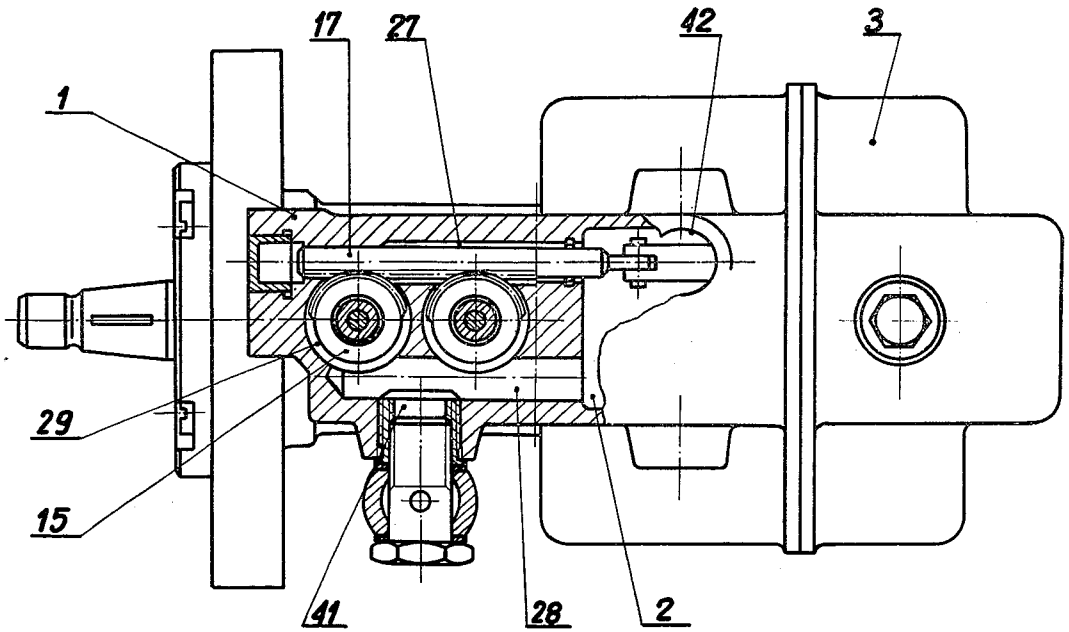
FIG. 3 is a top view with partial section taken along line III-III in FIG. 1.

The pump has a housing 1 with the rotation speed regulator (governor) and mechanisms located in the chamber 2 which is closed with a cover 3. The main pump elements are clearly shown in the cross-section (FIG. 1). The pressure units consisting of barrel 4 and plunger 5 are mounted in the holes 6 of the housing by using the flange mounting sleeves 7 screwed on the housing with screws 8.

Above the barrel 4 in the sleeve, the valve 9 is situated. The latter cuts off the connection between the working chamber 10 of the pressure unit and, (not shown) injection pipe screwed to the stub pipe 11 screwed which is into the sleeve 7. The stub pipe pushes the housing 12 of the cut-off valve to the front surface of the barrel 4 and thereby the flange 13 of the barrel 4 to the flange 14 in the lower part of the mounting sleeve. On the lower part of the barrel 4, projecting from the mounting sleeve 7, the sleeve 15 with toothed ring 16 is rotationally mounted. It is meshed with control rod 17. The sleeve 15, slidably coupled with the plunger 5, abuts with the flange against the upper disc 18 of the spring 19 the disc is fastened in the hole 6 of the housing with expansion ring 20. The bottom disc 21 of the spring, mounted in the roll tappet 22, is separably coupled with the foot 5a of the plunger 5. The spring 19 pushes the tappet 22 to the cam 23 of the transmission shaft 24 having bearings in the bottom part of the pump housing 1. At the end of the transmission shaft 24 projecting to the chamber 2 of the rotation regulator mechanism, the inertial rotation meter 25 is situated; it is coupled by the system of levers with the rod 17 regulating the pump metering.

The inlets of housing holes 6, where the pressure units are mounted, are tightly closed with mounting sleeves equipped with ring gasket 26. In the pump housing beneath the bottom edge of the mounting sleeve, two longitudinal holes 27 and 28 are located; traverse holes 6 are provided for pressure units. In one of them, the control rod 17 is slidably mounted with bearing; the next one 28 provides the channel delivering the fuel to the space 29 of pressure unit supply. The space of the supply is separated from the rest of the pump interior by top discs 18 of the springs. The barrel 4 of the pressure unit has two side holes 30 and 31, supply and overflow ones, which connect the work chamber with the supplying space.

The plunger, at some distance from the front, has an oblique groove with precisely machined edge 32 steering the fuel overflow from work chamber 10 to the supplying space.

The plunger makes the work stroke under the influence of the cam 23 and the back stroke under the influence of the spring 19 pushing the disc 18. The foot 5a of the plunger is mounted in the tappet. The chamber 10 is filled with fuel during the back stroke of the plunger 5. During the work stroke the plunger 5 closes at the first phase of the stroke (called plunger initial stroke) the holes 30 and 31 which results in the rapid increase of the pressure in the work chamber 10; it opens the cut-off valve and the atomizing nozzle and the fuel is injected to the combustion chamber. The fuel injection is finished when the steering edge 32 of the plunger uncovers the hole 31 through which the fuel from work chamber 10 flows into the space 29 of supply. The amount of fuel injected into the engine combustion chamber depends on the polar situation of steering edge 32 in relation to the overflow hole 31. Change of the situation of the steering edge in relation to the overflow hole can be obtained by the rotary movement of the plunger around its axis. This movement is made with the sleeve 15 meshed with control rod 17; longitudinal shift of the rod 17, coupled with the lever system of rotation regulator, causes the rotation of sleeve 15 and plunger 5. The wings 34 of the latter are guided axially in the shaped hole of the sleeve 15.

For proper action of the injection pump, it is necessary to set accurately the steering edge 32 of the plunger 5 in relation to the holes 30 and 31, both in polar and axial direction. The same polar situation of plunger in the pump, necessary for equal metering of the pressure units may be regulated during assembly by rotation of the barrel around its axis. This rotation is made by the polar transposition of the flange of the mounting sleeve 7 in relation to the screws 8. Axial positioning of the steering edge of plunger in the barrel is regulated by lifting or lowering the cylinder in relation to the plunger with spacers 35 placed between the flange of the sleeve 7 and the pump housing.

The pump interior has the following chambers: the space 29 of pressure units supply, the chamber 2 of the rotation regulator mechanism, the chambers 36 of springs and tappets and the chamber 37 of the transmission shaft. The chambers 36 of springs and tappets and the chamber 37 of the transmission shaft are called the chambers of the pump driving mechanism.

The space 29 of pressure units supply is connected with the chamber 2 of the rotation regulator mechanism with delivery channel 28, which is open at the side of this chamber, and with de-aerating channel 38 passing through the highest part of the supply space. The chambers 36 of the springs and tappets are connected to the chamber 2 of the rotation regulator mechanism with a channel 39 and the chamber of transmission shaft 24 - with gaps 40 in the transmission shaft bearing.

The supply pump presses the fuel through the pipe connected with the hole 41 to the channel 28 delivering the fuel to the space 29 of pressure units supply. The excess of fuel is led out from the pump by overflow hole 42, situated in the top wall of the chamber 2 of the rotation regulator mechanism over the end of control rod 17. The excess of fuel admitted into the space 29 of pressure units supply flows to the chamber 2 of the rotation regulator mechanism directly through the outlet of delivering channel 28 and through de-aerating channel 38 and indirectly through gaps around the discs 18 of springs to the chambers of the pump driving mechanism. From here it flows with channel 39 and through gaps 40 in the bearing to the chamber of the rotation regulator mechanism.

The flow of fuel from the chambers of the driving mechanism and the chamber 2 of the rotation regulator mechanism to the space of pressure units supply, is impossible since the supply space is directly connected to the supply pump and thus the fuel pressure in the supply space during the action of injection pump is always higher than in other pump chambers. Temporary changes in capacity of each chamber of the driving mechanism resulting from continuous movement of tappets and plungers cannot cause the flow of fuel from the driving mechanism chambers to the supply space, since the chambers 37 of springs and tappets and the chamber 37 of transmission shaft are connected through mutually independent channels with relatively large cross-section to the chamber of rotation regulator mechanism to which the overflow pipe 43 is connected.

Such a direction of the fuel flow through the pump interior assures good lubricating and cooling of the pump driving mechanism and, simultaneously, protects effectively the pressure units supply area against impurities, effervescence and aeration of the fuel.

The overflow pipe 43 is connected to the chamber 2 of the regulator mechanism through the valve 44, maintaining in the pump interior pressure above atmospheric pressure. This is necessary to avoid aeration of the pump.

The overflow hole 42 is situated over the end of the control rod 17 regulating the pump metering. After screwing out the overflow valve 44 through the hole 42, the movement of the regulation strip 17 can be observed.

Location of the discs 18 of springs directly adjacent to the channel 28 delivering the fuel gives, besides the reduced pump height, also some assembling advantages. Resisting rings 20 of discs 18 are partly uncovered through the channel 28 delivering the fuel which makes disassembling of the rings easier. After disassembling the ring 20, the disc 18 of the spring can be also disassembled without removing the control rod 17 by displacement the disc 18 aside to the channel 28 delivering the fuel. After removal of the disc 18 the spring 19 can also be disassembled.

In the pump, in accordance with present invention, the flange mounting of the pressure units can be replaced by the known flange-yoke mounting. If it is applied, the barrel of pressure units equipped with a narrow flange is mounted directly in the hole of the pump housing, the stub pipe of the injection pipe is screwed down directly into the barrel, and the barrel is mounted in the pump with a yoke screwed to the pump with screws (in the same manner as the sleeve — in the illustrations flange mounting of pressure units); the yoke pushes the barrel flange against the pump housing.

The present system of connection between the chambers of pump interior can be also used for other multisection series injection pumps in which the driving mechanism is lubricated with fuel.

The embodiments of the invention in which an exclusive property or privilege is claimed are defined as follows:

1. A multiple plunger injection pump for an internal combustion engine comprising, plungers arranged in alignment in one line, governor means, a housing common with said governor means, said housing having chambers all filled with fuel, said chambers holding said governor means, fuel supply means for supplying said fuel to said chambers under pressure to lubricate and cool the moving parts, pump barrels, said housing having bores holding said pump barrels and plungers, flange sleeves for mounting said barrels and plungers in said bores, said plungers moving in said barrels, a control rod linked to said barrels for rotational movement of the plungers in the barrels, said control rod regulating metering of the pump, a driving shaft, a cam on said driving shaft, a spring in one of said bores, expandable ring means for enclosing said spring in said hole, tappets pressed against said cam by said spring for reciprocal movement of said plungers, a passage supplying fuel to said fuel supply means, said plungers having spring discs in proximity of said passage supplying fuel to said fuel supply means, driving means having a driving chamber, said supply means being spaced from said driving chamber of said driving means by said spring discs, said spring discs having gaps, said supply means being connected to said driving chamber of said driving means through the gaps of said spring discs, part of the fuel supply to said supply means flowing to the driving chamber of said driving means through said gaps.

2. The pump as defined in claim 1 including passage means for connecting said supply means with said governor, said driving means having two chambers connected to said governor means by mutually independent passages, an overflow conduit connected to said governor, excess fuel from the interior of said housing draining off through said overflow conduit, said conduit being in the upper wall of said governor over an end of said control rod.

3. The pump as defined in claim 1 wherein said governor has a chamber, and channel means for the passage of fuel to the said supply means and opened from the sides of said chamber of said governor.

4. The pump as defined in claim 1 including air-bleeding passage means passing through a higher part of said supply means, said supply means being connected with a chamber of said governor by said air bleeding passage means.

5. The pump as defined in claim 1 including channel means supplying fuel to said supply means and uncovering partially rings of said spring discs.

* * * * *